United States Patent [19]

Schleif

[11] Patent Number: 4,948,285

[45] Date of Patent: Aug. 14, 1990

[54] BALL POINT PEN WITH TWO CARTRIDGES

[76] Inventor: Ludwig Schleif, Aloys' Schreiber-Str. 6, Buhl, Fed. Rep. of Germany

[21] Appl. No.: 289,221

[22] Filed: Dec. 22, 1988

[30] Foreign Application Priority Data

Dec. 24, 1987 [DE] Fed. Rep. of Germany ..... 3744100

[51] Int. Cl.[5] ..... B43K 29/00; B43K 27/12; B43K 24/12; B43K 24/14

[52] U.S. Cl. ..... 401/195; 401/30; 401/32; 401/33

[58] Field of Search ..... 401/29, 30, 32, 33, 401/31, 195

[56] References Cited

U.S. PATENT DOCUMENTS

| | | | |
|---|---|---|---|
| 641,230 | 1/1900 | Rice et al. | 401/32 |
| 2,071,510 | 2/1937 | Durrler | 401/33 |
| 2,170,761 | 8/1939 | Maucher | 401/31 |
| 2,826,173 | 3/1958 | Grossweiler et al. | 401/33 |
| 2,849,983 | 9/1958 | Gossweiler et al. | 401/33 |
| 3,237,605 | 3/1966 | Bourbon | 401/31 |
| 3,266,465 | 8/1966 | Ganz | 401/33 |
| 4,227,822 | 10/1980 | Kokubu | 401/33 X |
| 4,268,183 | 5/1981 | Sekiguchi | 401/32 X |

FOREIGN PATENT DOCUMENTS

| | | | |
|---|---|---|---|
| 182985 | 1/1955 | Austria | 401/32 |
| 257883 | 3/1988 | European Pat. Off. | 401/30 |
| 926408 | 4/1955 | Fed. Rep. of Germany | 401/33 |
| 59263 | 5/1954 | France | 401/33 |
| 706918 | 5/1966 | Italy | 401/31 |
| 256550 | 10/1946 | Switzerland | 401/32 |
| 272291 | 12/1950 | Switzerland | 401/33 |
| 1022608 | 3/1966 | United Kingdom | 401/31 |

*Primary Examiner*—Steven A. Bratlie
*Attorney, Agent, or Firm*—Collard, Roe & Galgano

[57] ABSTRACT

A writing instrument in the form of a ball pen has two cartridges capable of being alternately moved into the writing position by rotating the barrel. A provision is made for a space in the top part of the barrel for accommodating or receiving various accessory devices such as stamping mechanisms, marker pens or the like. The invention includes a guide tube housed within the barrel and having two longitudinal slots therein. Two slides having small tubes for receiving the writing cartridges, are movable back and forth on offset guide rails on the guide tube. The slides are forced into contact with a curve switching cam surface of a switching casing by springs. By rotating the switching casing, the one or other slide and thus the small tubes with the writing cartridges inserted therein are alternately pushed toward the bottom of the writing instrument and into the writing position.

1 Claim, 3 Drawing Sheets

BALL POINT PEN WITH TWO CARTRIDGES

BACKGROUND OF THE INVENTION

1. Field of the Invention

The invention relates to a writing instrument in the form of a ball point pen with two cartridges. More particularly, the invention relates to a ball point pen wherein one of two cartridges can be alternately moved into the writing position by rotating the barrel. The mechanism that moves the cartridges allows a space in the rearward part of the barrel for accommodating or receiving various accessory devices such as stamping mechanisms, marker pens, or the like.

2. Description of the Prior Art

With the writing instruments with multi-color cartridges known to date, in particular two-color cartridges, the alternating mechanism had to be located in the top or rearward part of the barrel. Thus, it was not possible to install additional accessories such as stamping mechanisms, marker pens, etc., adapted to be flipped out in the top part of the pen. A stamping mechanism of this type is disclosed in U.S. Pat. No. 4,606,665.

The present invention is intended to solve this problem by creating a writing instrument in which the mechanism for alternately moving the two-color cartridges into the writing position can be accommodated in the center or bottom part of the barrel. This permits the creation of a space in the top part of the writing instrument for accommodating the above-mentioned accessory devices. In addition, the mechanism for alternating the writing cartridges is designed in such a way that it can be easily dismantled without damage.

SUMMARY OF THE INVENTION

It is an object of the invention to provide a mechanism for alternately moving a pair of ball point pen cartridges into the writing position, which mechanism can be centrally located in the writing instrument to provide a space at the top thereof.

It is an additional object of the invention to provide a writing instrument having two alternating ink cartridges which is simple in design, economical to manufacture, and has an accessory element at the top thereof.

Accordingly, these and other objects are achieved by a ball point writing instrument or pen of the type which has a tubular guide accommodated in the barrel of the pen. Two slides with small tubes for receiving the writing cartridges are movable back and forth in the guide tube on offset guide rails. The slides are forced by springs against a curved switching cam surface of a rotatable switching casing. By rotating the casing, the one or the other slide, and thus the small tubes with the writing cartridges inserted and held therein, are alternately pushed toward the bottom of the writing instrument and into the writing position.

The significant advantage obtained with the writing instrument according to the present invention is that as a result of the special design of the mechanism for moving the two differently colored writing cartridges into the writing position, a space for receiving an accessory device, for example, a stamping mechamism, is created. This space is located in the top or rearward part of the writing instrument, as compared to conventional writing implements in which this space is used by the cartridge moving mechanism.

Other additional features of the writing instrument according to the present invention are provided. For example, the curved switching cam surface may be formed by cutting a section through a cylindrical casing. This section is inclined relative to the longitudinal axis of the writing instrument and is rounded off at its top side. In addition, provision is made for a V-shaped notch both at the top and bottom sides of the curve for arresting and holding the one or the other slide in its respective upper or lowermost position.

The slide consists of a generally semi-circular cylindrical segment with a nose on its outer side. This nose extends through a slot in the guide tube and is guided along the curve of the switching cam surface of the switching casing as it is rotated. Each slide also includes a small tube for receiving and holding the upper end of the writing cartridge. The tube receiving the writing cartridges is arranged on the slide at one end, whereby the small tube slides in corresponding bores in the end of the guide tube and is surrounded by a coil spring forcing the nose of the slide upwardly against the curved switching cam surface. The switching casing has a holding arrangement for supporting many types of different accessories such as, for example, stamping mechanisms, markers or the like, or other working parts in a space above the mechanism.

In order to permit non-destructive dismantling, provision is made for bores of about 2.5 millimeters in length in the guide tube and the switching casing. A special pair of pliers can be inserted through these bores in order to pull the guide tube from the switching casing without damaging it.

These and other objects and advantages of the present invention will become apparent from the following description of the accompanying drawings, which disclose one embodiment of the invention. It is to be understood that the drawings are to be used for purposes of illustration only, and not as a definition of the invention.

BRIEF DESCRIPTION OF THE DRAWINGS

Further advantages and details can be gleaned from the drawings wherein similar reference numerals denote similar elements throughout the several views.

DESCRIPTION OF THE PREFERRED EMBODIMENT

Figure 1:
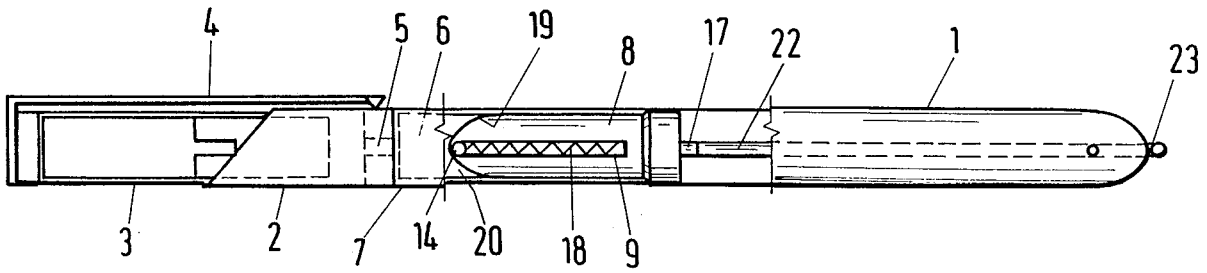
FIG. 1 is a side elevation view of the writing instrument of the present invention, with its outer surface partially cut away.
Figure 2:
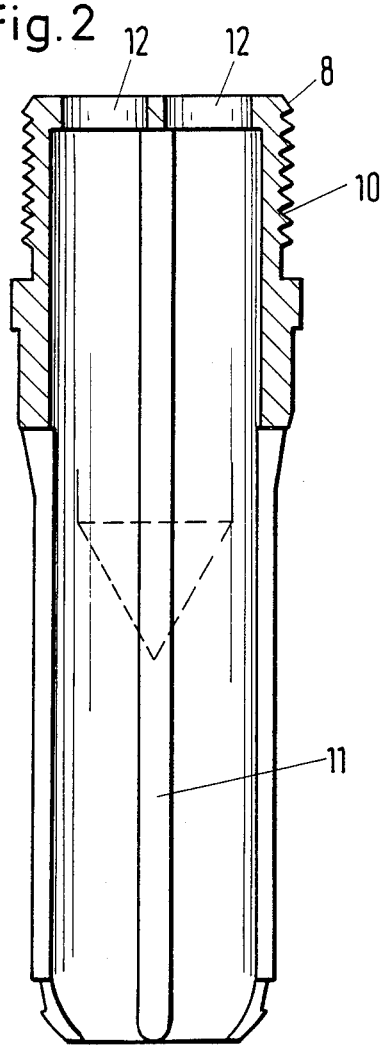
FIG. 2 is a cross-sectional view of the guide tube of the writing instrument of FIG. 1.
Figure 3:
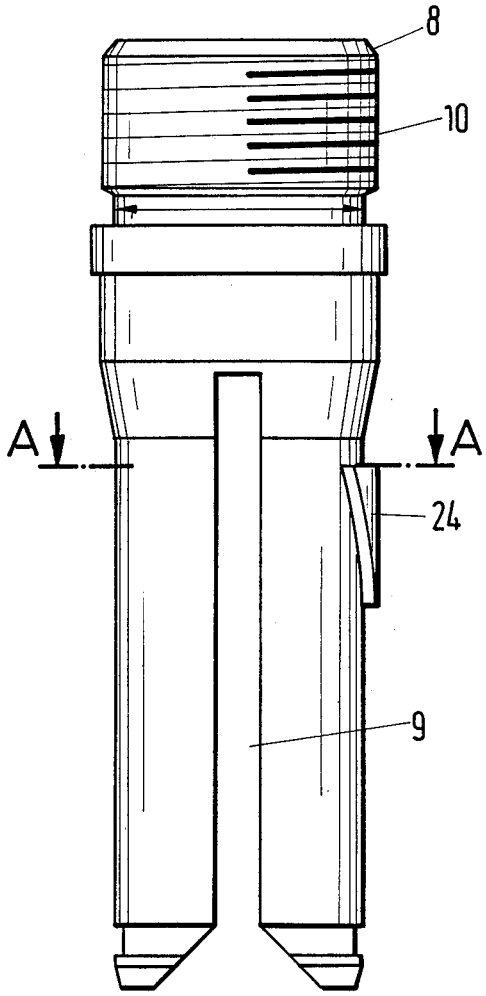
FIG. 3 is a side view of the guide tube of FIG. 2.
Figure 4:
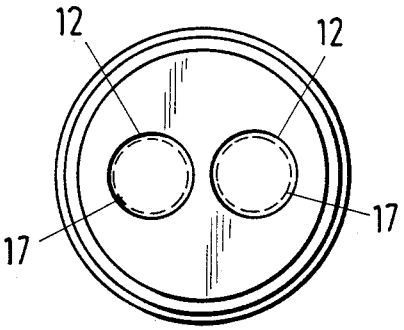
FIG. 4 is a top view of the guide tube of FIG. 3.
Figure 5:
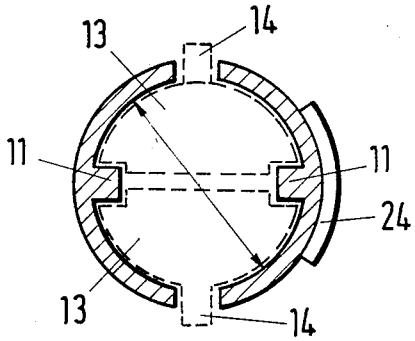
FIG. 5 is a cross-sectional view through the guide tube along line A—A in FIG. 3.

Referring to the FIGS., there is shown a writing instrument in the form of a ball pen consisting of a barrel having a bottom part 1 and a top part 2. The mechanism for moving the writing cartridges to the writing position is contained in the bottom part 1. Top part 2 has a space for accommodating accessories, for example, a stamping mechanism. The stamping mechanism may be replaced by other functional or working parts, for example, a marking pen or some other device.

The space receiving the stamping mechanism is covered by a displaceable cap 3 and, on the outside, has a downwardly extending clip 4 for holding the pen in a shirt pocket. The stamping mechanism or other working part is connected with an upper portion 6 of a switching casing 20 by means of a holder 5. Holder 5 is connected with the stamping mechanism or other working part, via a matching bushing, and portion 6 is surrounded by a protective sleeve 7.

Referring to FIGS. 2 to 5, there is shown a guide tube 8, which consists of a cylindrical hollow body having a slot 9 along each of two opposite longitudinally extending sides. At one end, guide tube 8 has a thread 10. Furthermore, in the interior space of guide tube 8, two guide rails 11 are provided, which are disposed opposite each other and displaced by 90° relative to the longitudinal slots. On its bottom surface, guide tube 8 has two circular bores 12.

Figure 6:
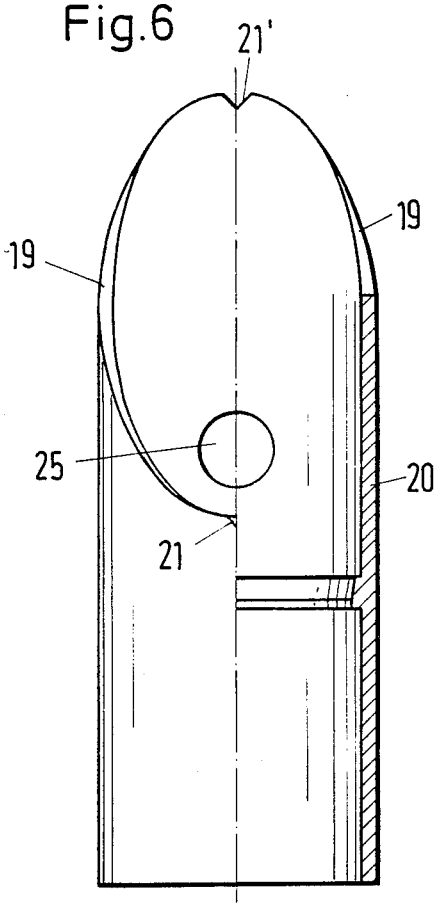
FIG. 6 is a side view of the switching casing partially in cross-section.
Figure 7:
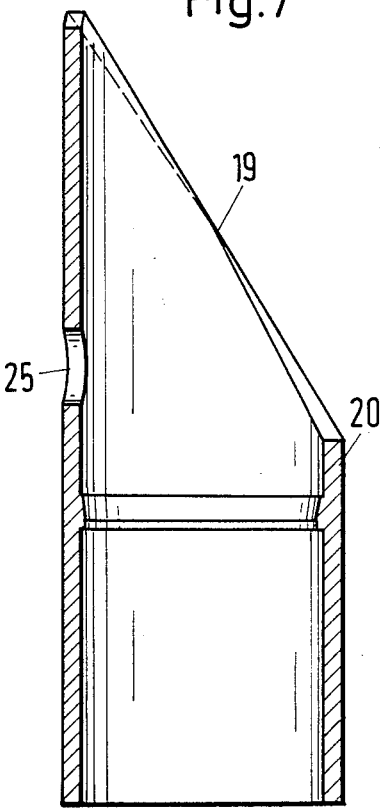
FIG. 7 is a side view of FIG. 6.
Figure 8:
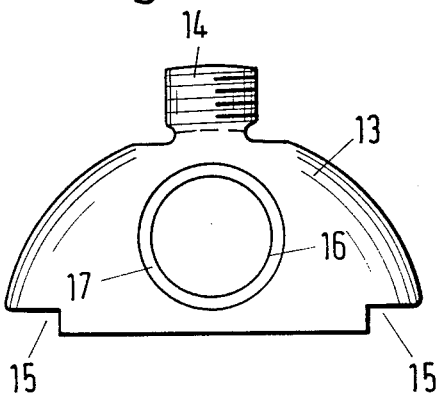
FIG. 8 is a top view of a slide.
Figure 9:
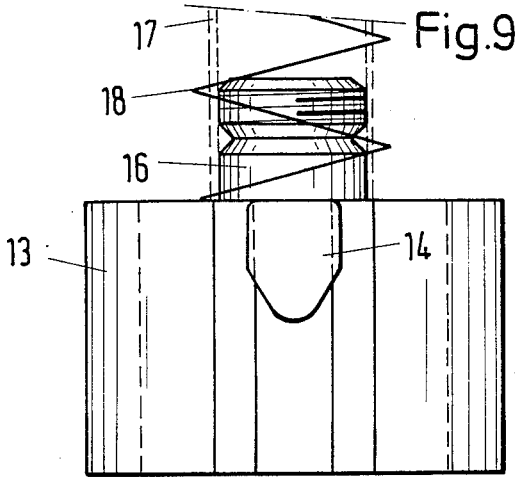
FIG. 9 is a side view of the slide of FIG. 8.

Referring to FIGS. 8 and 9, there is shown a pair of slides which are inserted in guide tube 8 from the open end in such a way that the noses 14, which project outwardly from the slides, slidably engage longitudinal slots 9. Two slides 13, with recesses 15 on their inner sides, rest on rails 11. Furthermore, on their bottom side, each of the slides engaging the writing cartridges has a cylindrical attachment 16 with a small tube 17 inserted over attachment 16. The upper end of small tube 17 projects into the guide tube through an associated bore 12 when the slide is in the downward position. A spiral coil spring 18 is mounted on each of small tubes 17, the latter being seated on the two slides 13 at its end surface facing bottom part 1. The springs 18 force slides 13 upwardly against the curved switching cam surface 19 of a switching casing 20 shown in FIGS. 6 and 7. The curved switching cam surface of the switching casing 20 has, at its lowermost point, a V-shaped notch 21 and, optionally, a notch 21' at the uppermost point thereof.

To move or alternate the two writing cartridges in the writing instrument according to the invention, use is made of nose 14 on both slides 13 and the cam surface on switching casing 20. In the starting position, one slide 13 is in the upper or the left stop position, as shown in FIG. 1, due to the pressure of the spring 18. Thus, nose 14 of slide 13 is positioned in V-shaped notch 21' of the curved switching cam surface 19. This means that, as shown in FIG. 1, the front cartridge 22, connected with the small tube 17, is in the upper or retracted position in barrel part 1.

On the other side, the other slide 13, with its nose 14, is disposed and held in V-shaped notch 21 of the curved switching cam surface 19 of switching casing 20. This means that the writing cartridge 23 connected therewith is in the foremost position, i.e., the ball point tip of the cartridge projects from bottom part 1 of the barrel in the writing position.

Now, in order to exchange the writing cartridges 22, 23, it is necessary only to rotate casing 20 with respect to guide tube 8. This may be accomplished, for example, by rotating the barrel part 1 relative to barrel part 2 and fixing one or the other of casing 20 or guide tube 8 to these barrel parts. Such rotary motion causes the switching cam surface 19 to push the nose 14 of one slide 13 downward to the writing position. At the same time, the other slide is pushed up by the action of the spiral spring 18 because its nose 14, also, rests against a curved cam surface 19 of switching casing 20. As casing 20 is rotated this curved cam surface allows nose 14 to travel upwardly. Consequently, the one ball pen cartridge 23 is retracted and the other ball pen cartridge 22 is pushed through the opening in the front barrel part 1 into its working position. Furthermore, provision is made for a V-shaped stop 24 on the guide tube in order to limit the rotary motion of casing 20 with respect thereto.

When slides 13 are displaced lengthwise, their outer contours rest against the inside of guide tube 8 and slides 13 slide back and forth on offset guide rails 11 without any interference with their motion. Thus, guide rails 11 assure the free travel of the slides, preventing the latter from contacting and obstructing one another. Furthermore, provision is made for a bore 25 in switching casing 20 adapted to coincide with a bore in the protective sleeve 7. Thus, guide tube 8 may be pulled from switching casing 20 by means of a special pair of pliers without being damaged.

Due to the fact that the slides are forced against the curved switching cam surface 19 of switching casing 20 by means of the two pressure springs mounted within guide tube 8, very little space is required behind cartridges 22, 23, so that an adequately large space is created for accessories such as, for example, stamping mechanisms, fiber pens, or the like. The significant advantage accomplished with the writing instrument of the present invention is that, as opposed to the known writing implements with multiple cartridges, the construction of its actuation mechanism is short.

While one embodiment of the present invention has been illustrated and described, it is obvious that many changes and modifications may be made thereunto, without departing from the spirit and scope of the invention.

What is claimed is:

1. A writing instrument in the form of a ball-point pen having two ink cartridges which, through turning of the shaft, can be alternately brought into writing position, said writing instrument comprising means defining a space provided at the rear of the shaft to accommodate stamping mechanisms, in combination with (a) a longitudinally extending barrel forming the shaft of said ballpoint pen;

(b) a longitudinally extending guide tube mounted within said barrel, said guide tube having two oppositely disposed lateral, longitudinally extending slots and two oppositely disposed lateral, longitudinally extending rails, said slots and said rails being displaced from one another.

(c) a pair of slides slidably mounted in said guide tube to be moved towards and away from the writing position, each slide consisting of a semicylindrical segment having a nose thereon extending into one of said slots of said guide tube, a pair of recesses engaging said rails of said guide tube, and an extension on the writing position side on which a tube is mounted surrounded by a coil spring biasing said slide away from the writing position onto which tube an ink cartridge is mounted; and (d) a generally tubular switching casing rotatably surrounding said guide tube, said switching casing having downwardly facing curved switching cam surfaces engaging a portion of each of said slides, said cam surfaces including a first portion engaging one of said slides when said slide is in a retracted position and a second portion engaging said other slide when said other slide is in the writing position, so that rotation of said casing causes said first portion of said cam surfaces to move the respective slide downwardly against said biasing means into the writing position as said second portion of said cam surfaces allows said other slide to move upwardly away from the writing position, said switching casing further having a bore alignable with a bore in a protective sleeve surrounding said casing and a holder for the attachment of an accessory device;

wherein said switching casing is a tube and the curved switching cam surface of said switching casing is formed by sectioning said casing at an angle inclined relative to a longitudinal axis thereof, said switching cam surface having a V-shaped notch at an apex thereof for arresting said nose of each of said slides.

* * * * *